United States Patent [19]

Greenhalgh

[11] 4,339,740

[45] Jul. 13, 1982

[54] THERMALLY RESPONSIVE SWITCHES

[75] Inventor: Keith Greenhalgh, Lancashire, England

[73] Assignee: The General Electric Company Limited, London, England

[21] Appl. No.: 271,247

[22] Filed: Jun. 8, 1981

[30] Foreign Application Priority Data

Jun. 6, 1980 [GB] United Kingdom ..... 8018670

[51] Int. Cl.[3] ..... H01H 61/00

[52] U.S. Cl. ..... 337/39; 337/335; 337/370

[58] Field of Search ..... 337/38, 39, 40, 335, 337/336, 354, 370, 371, 379

[56] References Cited

U.S. PATENT DOCUMENTS

| | | | |
|---|---|---|---|
| 2,363,376 | 11/1944 | Woodman | 337/379 X |
| 3,833,876 | 9/1974 | Bassett | 337/370 |
| 3,878,499 | 4/1975 | Concin | 337/354 |
| 3,943,480 | 3/1976 | Schmitt | 337/354 |

FOREIGN PATENT DOCUMENTS

| | | | |
|---|---|---|---|
| 2508807 | 11/1975 | Fed. Rep. of Germany | 337/370 |
| 1172386 | 11/1969 | United Kingdom | 337/370 |
| 2021522 | 11/1979 | United Kingdom | 337/370 |

*Primary Examiner*—George Harris

*Attorney, Agent, or Firm*—Kirschstein, Kirschstein, Ottinger & Cobrin

[57] ABSTRACT

A thermally responsive electric switch including two dimensionally identical, bimetallic, snap-over, part-spherical, thermally responsive actuating elements 9, 11, arranged in a nesting, contacting relationship within the end portion 7 of a housing. The first element 9 changes from a first to a second curvature when its temperature rises above a first predetermined temperature, returning to its first curvature if its temperature falls below a second, lower, predetermined temperature. The second element 11 changes from a first to a second curvature when its temperature rises above a third predetermined temperature higher than the first temperature, and thereafter remains in that curvature. A common force transmitting rod 13 bearing on the uppermost element 11 transmits the movement of both elements to a pair of contacts 3 at the other end of the housing, the contacts being in one condition when both plates have the first curvature, and otherwise being in a second condition.

3 Claims, 4 Drawing Figures

THERMALLY RESPONSIVE SWITCHES

Figure 1:
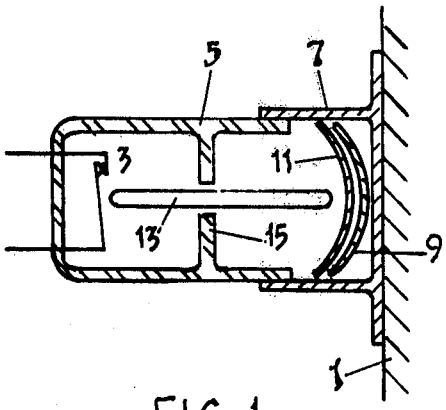

This invention relates to thermally responsive electric switches.

The invention relates particularly to thermally responsive electric switches of the kind, incorporating a thermally responsive actuating element arranged to operate a pair of contacts of the switch so that the switch contacts change from a first condition to a second condition when the temperature of the element rises above a first predetermined temperature and return to said first condition when the temperature of the element falls below a second, lower, predetermined temperature.

Such switches find wide application in controlling the electric supply to an electric heater to maintain the temperature of the heater or an associated body at approximately a constant temperature.

In such an arrangement due to thermal inertia effects there is typically a small upward swing in temperature of the actuating element after the switch has cutoff the electric supply. Under abnormal conditions this overswing may become dangerously large, bearing in mind that parts of the arrangement nearer the heater will be even hotter. This may occur, for example, in the case of a switch controlling the supply of electricity to a heater in a water tank if the tank becomes empty. This can occur, for example, due to progressive evaporation if the water supply to the tank is off whilst the electricity supply for the heater remains on. To overcome this problem it is known to provide a second thermally responsive actuating element which is arranged to prevent the switch contacts resuming their first condition due to operation of the first element if the temperature of the second element has exceeded a third predetermined temperature above said first predetermined temperature.

It has been proposed that such a thermally responsive electric switch should comprise first and second snap-over bimetallic substantially part-spherical thermally responsive actuating elements which reverse curvature with a snap-action in operation, the two elements being disposed at one end of a housing so that their centres move along a common axis in operation coaxial with the housing axis; a pair of electrical contacts disposed at the other end of said housing; a common force transmitting member arranged to transmit the movement of either plate to the contacts, the contacts being in a first condition only when both plates have a first curvature, the contacts otherwise being in a second condition, the first element reversing from its first curvature to its second curvature when its temperature rises above a first predetermined temperature, and returning to its first curvature if its temperature subsequently falls below a second, lower, predetermined temperature, and said second element reversing from its first curvature to its second curvature when its temperature rises above a third predetermined temperature higher than said first predetermined temperature and thereafter retaining this curvature regardless of temperature, at least over a range extending apprecially below said second predetermined temperature, thus maintaining the switch contacts in their second condition. Such a switch is hereinafter referred to as a thermally responsive electric switch of the kind specified.

One example of a switch of the kind specified is described in German Patent Specification No. 2,508,807.

It is an object of the present invention to provide a thermally responsive electric switch of the kind specified which is of relatively simple, and therefore inexpensive form.

According to the present invention in a thermally responsive electric switch of the kind specified said first and second elements are dimensionally substantially identical and are freely supported between the force transmitting member and the adjacent end of the housing, so as to lie in nesting contacting relationship, concave towards said member when both elements have their first curvature, the element nearer the force transmitting member bearing directly on the end of said member and the other element bearing on said end of said member via said nearer element.

One thermally responsive switch in accordance with the invention will now be described, by way of example, with reference to the accompanying drawings in which FIGS. 1 to 4 are corresponding sectional views of the switch in various operational states.

Referring to the drawings, the switch is mounted on the wall 1 of a water tank and incorporates a normally closed spring-loaded pair of electric contacts 3 which control the supply of electric current to an electric heater (not shown) arranged to heat the water in the tank.

The contacts 3 are housed at one end of a cylindrical housing 5 which suitably consists of moulded plastics material.

At its other end the housing 5 is closed by a stainless steel cup-shaped cap 7 which is in good thermal contact with the water tank wall 1.

Within the cap portion of the housing there are two dimensionally identical part-spherical snap-over bimetal elements 9 and 11, both elements thus being maintained substantially at the temperature of the tank wall 1. The elements 9 and 11 are arranged to actuate the switch contacts via a force transmitting rod 13 which extends centrally along the housing 5 and is slideably supported in an aperture formed centrally in an internal wall 15 in the housing, the elements being freely supported within the cap 7 between the end of the rod 13 and the base of the cap 7 with their edges adjacent the curved wall of the cap 7.

Figure 2:
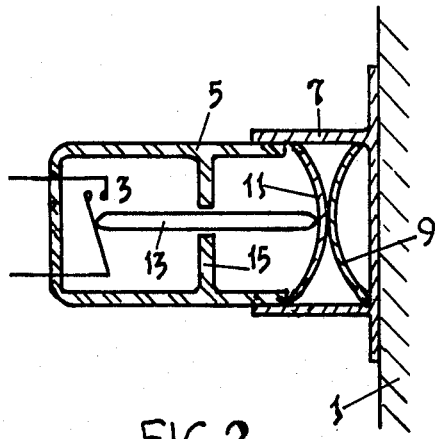

In normal operation of the switch, when the temperature of the elements 9 and 11, and hence the water in the tank, is below the desired water temperature, both elements are concave towards the push rod 13 and are thus in nesting contacting relationship with the rod fitting loosely between the contacts 3 and the nearer element 11, as shown in FIG. 1, the two elements being shown slightly separated for the sake of clarity. The contacts 3 are therefore closed and the water heater is energised. Referring now to FIG. 2, when the water temperature exceeds the desired value the element 9 further from the rod 13 reverses its curvature with a snap-action and in so doing its edge contacts the base of the cap 7 so that its centre bears on the rod 13 via the other element 11, thereby opening the contacts 3 and de-energising the water heater. When the water temperature falls below its desired value by a small amount, determined by the design of the element 9, the element 9 snaps back into its original shape allowing the contacts 3 to re-close and energise the water heater again.

In normal operation this cycle of operations repeats so as to maintain the water in the tank at approximately the desired temperature.

Figure 3:
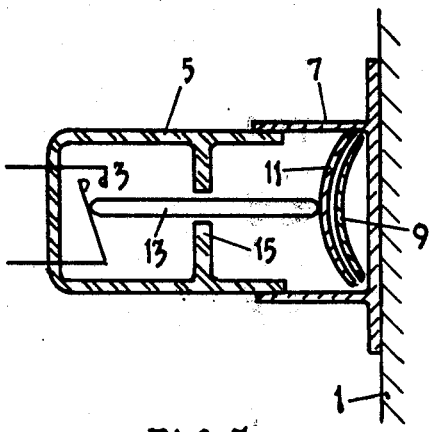

In the event of an abnormally high temperature occurring adjacent the switch, both elements 9 and 11 reverse curvature and the contacts 3 open as shown in FIG. 3, the element 11 bearing directly on the end of the rod 13 with the element 9 fitting in nesting relationship with the element 11 between the elements 11 and the base of the cap 7.

Figure 4:
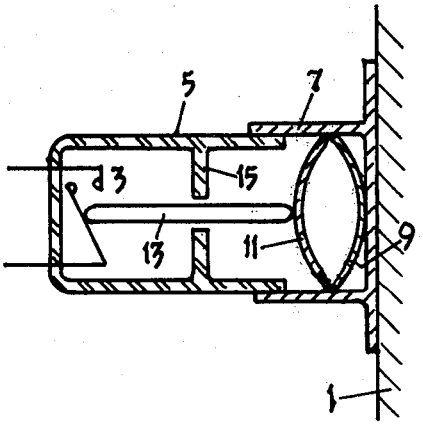

The element 11 is designed so as to retain its reverse curvature shape, i.e. convex towards the rod 13 despite subsequent lowering of its temperature below the temperature it assumes reverse curvature. Consequently, when the temperature falls sufficiently to return the element 9 to its shape concave towards the rod 13, the elements 9 and 11 co-operate to maintain the contacts 3 open, as shown in FIG. 4.

As will be seen, both elements 9 and 11 now bear on the rod 13, the element 11 directly and the element 9 via the element 11, the centres of the elements 11 and 9 respectively contacting the end of the rod 13 and the base of the cap 7, and the elements contacting one another only around their edges.

The element 11 may be designed so that it returns to its shape concave towards the rod 13 only by physical manipulation, or when its temperature is abnormally cool e.g. below 0° C.

In alternative arrangements in accordance with the invention, the positions of the elements 9 and 11 may be interchanged so that the element 11 is nearer the rod 13.

In one particular embodiment of the switch described by way of example the element 9 is designed to close the contacts 3 at a temperature of 45° C. and open the contacts 3 at a temperature of 60° C., and the element 11 operates at 70° C.

I claim:

1. A thermally responsive electric switch including first and second snap-over bimetallic substantially part-spherical thermally responsive actuating elements which reverse curvature with a snap-action in operation, the two elements being disposed at one end of a housing so that their centres move along a common axis in operation coaxial with the housing axis; a pair of electrical contacts disposed at the other end of said housing; a common force transmitting member arranged to transmit the movement of either plate to the contacts, the contacts being in a first condition only when both plates have a first curvature, the contacts otherwise being in a second condition, the first element reversing from its first curvature to its second curvature when its temperature rises above a first predetermined temperature, and returning to its first curvature if its temperature subsequently falls below a second, lower, predetermined temperature, and said second element reversing from its first curvature to its second curvature when its temperature rises above a third predetermined temperature higher than said first predetermined temperature and thereafter retaining this curvature regardless of temperature, at least over a range extending appreciabl below said second predetermined temperature, thus maintaining the switch contacts in their second condition including the improvement that said first and second elements are dimensionally substantially identical and are freely supported between the force transmitting member and the adjacent end of the housing, so as to lie in nesting contacting relationship, concave towards said member when both elements have their first curvature, the element nearer the force transmitting member bearing directly on the end of said member and the other element bearing on said end of said member via said nearer element.

2. A thermally responsive electric switch according to claim 1 in which said housing compirses a cup-shaped metal end portion in which said elements are disposed and a portion of insulating material which fits within said such portion and carries said contacts.

3. A thermally responsive electric switch according to claim 2 in which said force transmitting member consists of a rod slideably supported in an aperture formed centrally in an internal wall of said portion of insulating material.

* * * * *